US011828479B2

(12) United States Patent
Kawai et al.

(10) Patent No.: US 11,828,479 B2
(45) Date of Patent: Nov. 28, 2023

(54) SERVER BASED AIR CONDITIONING SYSTEM ADAPTOR FOR UPDATING CONTROL PROGRAM

(71) Applicant: FUJITSU GENERAL LIMITED, Kanagawa (JP)

(72) Inventors: Tomofumi Kawai, Kanagawa (JP); Yutaka Shimamura, Kanagawa (JP); Masae Kitajima, Kanagawa (JP); Koichi Kitami, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 146 days.

(21) Appl. No.: 17/421,876

(22) PCT Filed: Dec. 19, 2019

(86) PCT No.: PCT/JP2019/049791

§ 371 (c)(1),
(2) Date: Jul. 9, 2021

(87) PCT Pub. No.: WO2020/149093

PCT Pub. Date: Jul. 23, 2020

(65) Prior Publication Data

US 2022/0113048 A1 Apr. 14, 2022

(30) Foreign Application Priority Data

Jan. 16, 2019 (JP) ..... 2019-005445

(51) Int. Cl.
*F24F 11/58* (2018.01)
*F24F 11/63* (2018.01)
*F24F 120/20* (2018.01)

(52) U.S. Cl.
CPC ..... *F24F 11/58* (2018.01); *F24F 11/63* (2018.01); *F24F 2120/20* (2018.01)

(58) Field of Classification Search
CPC ..... H04L 67/34; H04L 67/10; H04L 67/125; F24F 11/30; F24F 11/63; G06F 8/65;
(Continued)

(56) References Cited

U.S. PATENT DOCUMENTS 10,761,833 B2 * 9/2020 Gourlay ..... F24F 11/58
10,803,392 B1 * 10/2020 Khan ..... H04L 67/10
(Continued)

FOREIGN PATENT DOCUMENTS

CN 101039202 9/2007
CN 103873946 6/2014
(Continued)

OTHER PUBLICATIONS

International Search Report issued in International Patent Application No. PCT/JP2019/049791, dated Feb. 4, 2020, along with an English translation thereof.
(Continued)

*Primary Examiner* — Darrin D Dunn
(74) *Attorney, Agent, or Firm* — Greenblum & Bernstein, P.L.C.

(57) ABSTRACT

An air conditioning system includes an air conditioner and an adapter that connects the air conditioner and an external server device. The adapter includes a first updating unit and a second updating unit. The first updating unit updates, when a new learning model that provides a recommended operation to a control unit included in the air conditioner is received from the external server device, the learning model by using a first update method. The second updating unit updates, when an update purpose control program that updates a control program for the air conditioner is received from the external server device, the update purpose control program by using a second update method that is different from the first update method. It is possible to reduce an
(Continued)

adapter load by updating the learning model and the control program by using different methods.

3 Claims, 9 Drawing Sheets

(58) Field of Classification Search
CPC ..... G06F 8/61; G06F 11/1433; G06F 8/60; G06F 8/654; G05B 2219/2614; G05B 19/056
See application file for complete search history.

(56) References Cited

U.S. PATENT DOCUMENTS

2005/0055595 A1* 3/2005 Frazer ..... G06F 8/654 713/400
2005/0257206 A1* 11/2005 Semerdzhiev ..... G06F 8/65 717/168
2006/0218545 A1* 9/2006 Taguchi ..... G06F 8/656 717/171
2011/0153089 A1* 6/2011 Tiemann ..... G05B 19/056 700/276
2014/0058567 A1 2/2014 Matsuoka et al.
2014/0289864 A1* 9/2014 Dimitrakos ..... G06F 21/121 726/26
2017/0269922 A1 9/2017 Tian et al.
2018/0209681 A1 7/2018 Song et al.
2018/0283723 A1 10/2018 Ock et al.
2018/0367378 A1 12/2018 Sugioka
2019/0073210 A1 3/2019 Sano
2019/0087169 A1 3/2019 Arai
2019/0114162 A1 4/2019 Izumi
2019/0129710 A1 5/2019 Izumi
2019/0324738 A1* 10/2019 Gourlay ..... G06F 8/61
2020/0050443 A1* 2/2020 Edelsten ..... G06T 5/002
2020/0342358 A1* 10/2020 Flanagan ..... G06N 5/04
2020/0349473 A1* 11/2020 Idesawa ..... G06N 5/01
2020/0380387 A1* 12/2020 Pourmohammad ..... G06N 5/04
2021/0174249 A1* 6/2021 Hernandez Herranz ..... G06N 3/088

FOREIGN PATENT DOCUMENTS

CN 106339242 1/2017
CN 106680698 5/2017
EP 1953468 8/2008
EP 3029389 6/2016
EP 3411634 10/2018
EP 3699506 8/2020
JP 2009-133549 6/2009
JP 2015-117933 6/2015
JP 2016-143318 8/2016
JP 2018-005894 1/2018
JP 2018-092288 6/2018
JP 2019-008645 1/2019
JP 2019-074279 5/2019
JP 2008-190853 8/2021
TW 201621239 6/2016
WO 2017/199331 11/2017

OTHER PUBLICATIONS

Written Opinion of the International Searching Authority issued in International Patent Application No. PCT/JP2019/049791, dated Feb. 4, 2020.
Extended European Search Report issued in International Patent Application No. PCT/JP2019/049791, dated Sep. 15, 2020.
Office Action issued for corresponding Australian Patent Application No. 2019423025, dated Apr. 6, 2022.
Office Action issued for corresponding Chinese Patent Application No. 201980087588.X, dated Apr. 27, 2022, and corresponding English translation.

* cited by examiner

SERVER BASED AIR CONDITIONING SYSTEM ADAPTOR FOR UPDATING CONTROL PROGRAM

FIELD

The present invention relates to an air conditioning system.

BACKGROUND

An air conditioning system having a learning function can reflect, if a storage unit has the learning function, a suitable temperature environment in time series obtained based on the preferences, action patterns, or the like of residents or the like in control performed based on the standard specification setting (for example, Patent Literature 1).

Furthermore, there is a known system for receiving an update purpose control program from a server device and automatically performing an update, when, for example, an air conditioning system receives a notification of updating a control program stored in the air conditioning system from a server device (for example, Patent Literature 2).

CITATION LIST

Patent Literature

Patent Literature 1: Japanese Laid-open Patent Publication No. 2015-117933

Patent Literature 2: Japanese Laid-open Patent Publication No. 2008-190853

SUMMARY

Technical Problem

If an adapter that relays communication between the server device and an indoor unit is used, it is conceivable to allow the adapter to have a function for receiving the update purpose control program for the indoor unit from the server device, temporarily storing the received update purpose control program in the adapter, and sending the temporarily stored update purpose control program to the indoor unit. In contrast, it is conceivable to allow the server device to perform machine learning and generate a trained model based on the collected data by allowing the adapter to periodically collect operation data, such as a preferred temperature and an air flow, of the residents or the like from the indoor unit and send the collected data to the server device. In this case, by allowing the trained model to be stored in the adapter, the adapter can provide a recommended operation to a control unit included in the indoor unit by using the storing learning model. Furthermore, it is conceivable to allow the adapter to have a function for receiving a new learning model from the server device and updating the storing learning model to the received new learning model.

The inventors of the present application found a problem in that, if the adapter is allowed to have the above described function, a processing load of the adapter is increased due to an update of the learning model and the control program.

Accordingly, the present invention has been conceived in light of the circumstances described above and an object thereof is to provide an air conditioning system that can reduce an adapter load by updating the learning model and the control program by using different methods.

Solution to Problem

According to an aspect, an air conditioning system includes an air conditioner and an adapter that connects the air conditioner and an external server device. The adapter includes a first updating unit and a second updating unit. The first updating unit updates, when a new learning model that provides a recommended operation to a control unit included in the air conditioner is received from the external server device, the learning model by using a first update method. The second updating unit updates, when an update purpose control program that updates a control program for the air conditioner is received from the external server device, the update purpose control program by using a second update method that is different from the first update method.

Advantageous Effects of Invention

As an aspect of an embodiment, it is possible to reduce an adapter load by updating the learning model and the control program by using different methods.

DESCRIPTION OF EMBODIMENTS

Preferred embodiments of an air conditioning system disclosed in the present invention will be explained with reference to accompanying drawings. Furthermore, the disclosed technology is not limited to each of the embodiments. Furthermore, the embodiments described below may also be modified as long as the embodiments do not conflict with each other.

Embodiment

Figure 1:
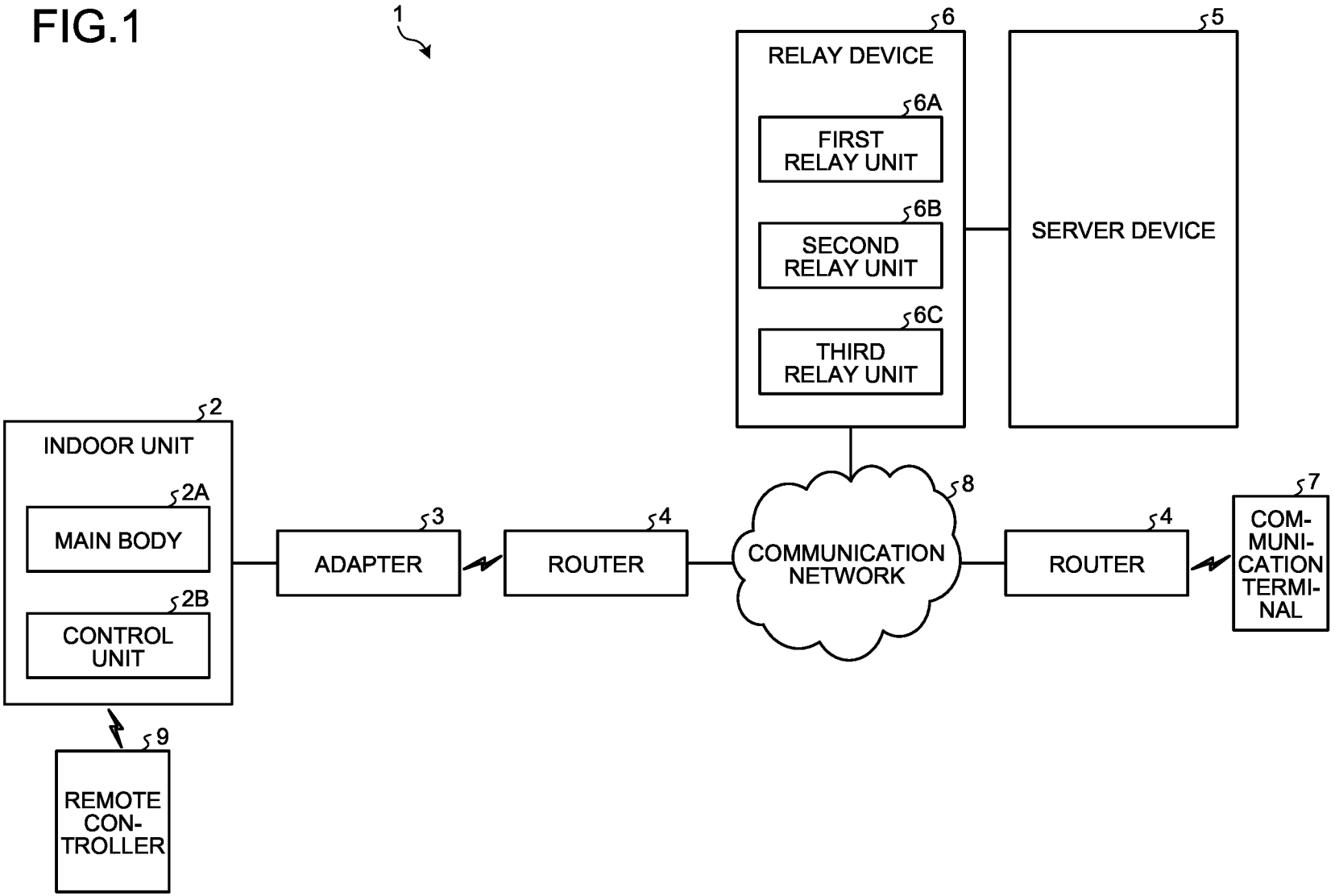
FIG. 1 is a diagram illustrating an example of an air conditioning system according to an embodiment.

FIG. 1 is a diagram illustrating an example of an air conditioning system 1 according to an embodiment. The air conditioning system 1 illustrated in FIG. 1 includes an indoor unit 2, an adapter 3, a router 4, a server device 5, a relay device 6, a communication terminal 7, and a communication network 8.

The indoor unit 2 is a part of an air conditioner that is arranged in, for example, a room and that heats or cools the air in the room. Furthermore, a user of the indoor unit 2 can perform a remote operation on the indoor unit 2 operated by a remote controller 9. The indoor unit 2 includes a main body 2A and a control unit 2B that controls the main body 2A. The main body 2A has an indoor fan and an indoor heat exchanger, and the room air that has been subjected to heat exchange by the indoor heat exchanger is blown out from the main body 2A, whereby air heating, cooling, dehumidification or the like of the room is performed. Furthermore, an outdoor unit (not illustrated) has an outdoor fan, a compressor, or the like. The communication terminal 7 is a terminal device, such as a smartphone, held by the user.

The adapter 3 has a communication function for connecting the indoor unit 2 and the router 4 by wireless communication and a control function for performing artificial intelligence (AI) control on the indoor unit 2. The adapter 3 is arranged for each of the indoor units 2. The router 4 is a device provided at an access point that connects the adapter 3 and the communication network 8 by wireless communication using, for example, a wireless local area network (WLAN) or the like. The communication network 8 is a communication network, such as the Internet. The server device 5 has a function for generating a learning model of the AI that controls the indoor unit 2 and has a database or the like that stores therein operation history data or the like. Furthermore, the server device 5 is arranged in, for example, a data center. The relay device 6 has a function for connecting to the communication network 8 in communication and connecting to the server device 5 in communication. The relay device 6 sends operation history data or the like that is used to generate or update the learning model applied to the indoor unit 2 through the communication network 8 from the adapter 3 to the server device 5. Furthermore, the relay device 6 sends the learning model generated or updated by the server device 5 to the adapter 3 through the communication network 8. Furthermore, the relay device 6 is arranged in, for example, the data center or the like.

The relay device 6 includes a first relay unit 6A, a second relay unit 6B, and a third relay unit 6C. The first relay unit 6A sends various kinds of data related to AI control between the adapter 3 and the server device 5. The first relay unit 6A sends, to the server device 5 through the communication network 8, the operation history data or the like that is used to generate or update the learning model received from the adapter 3 and also sends the learning model generated or updated by the server device 5 to the adapter 3 through the communication network 8. The second relay unit 6B acquires an operation condition (an operation mode, such as a cooling/heating mode, a set temperature, etc.) of the indoor unit 2 that has been set by using the communication terminal 7 by the user from the outside and sends the acquired operation condition to the indoor unit 2. The third relay unit 6C acquires external data, such as a weather forecast, from, for example, the communication network 8, such as the Internet, and sends the acquired external data to the server device 5. Furthermore, the third relay unit 6C sends the external data to the adapter 3 through the communication network 8.

Figure 2:
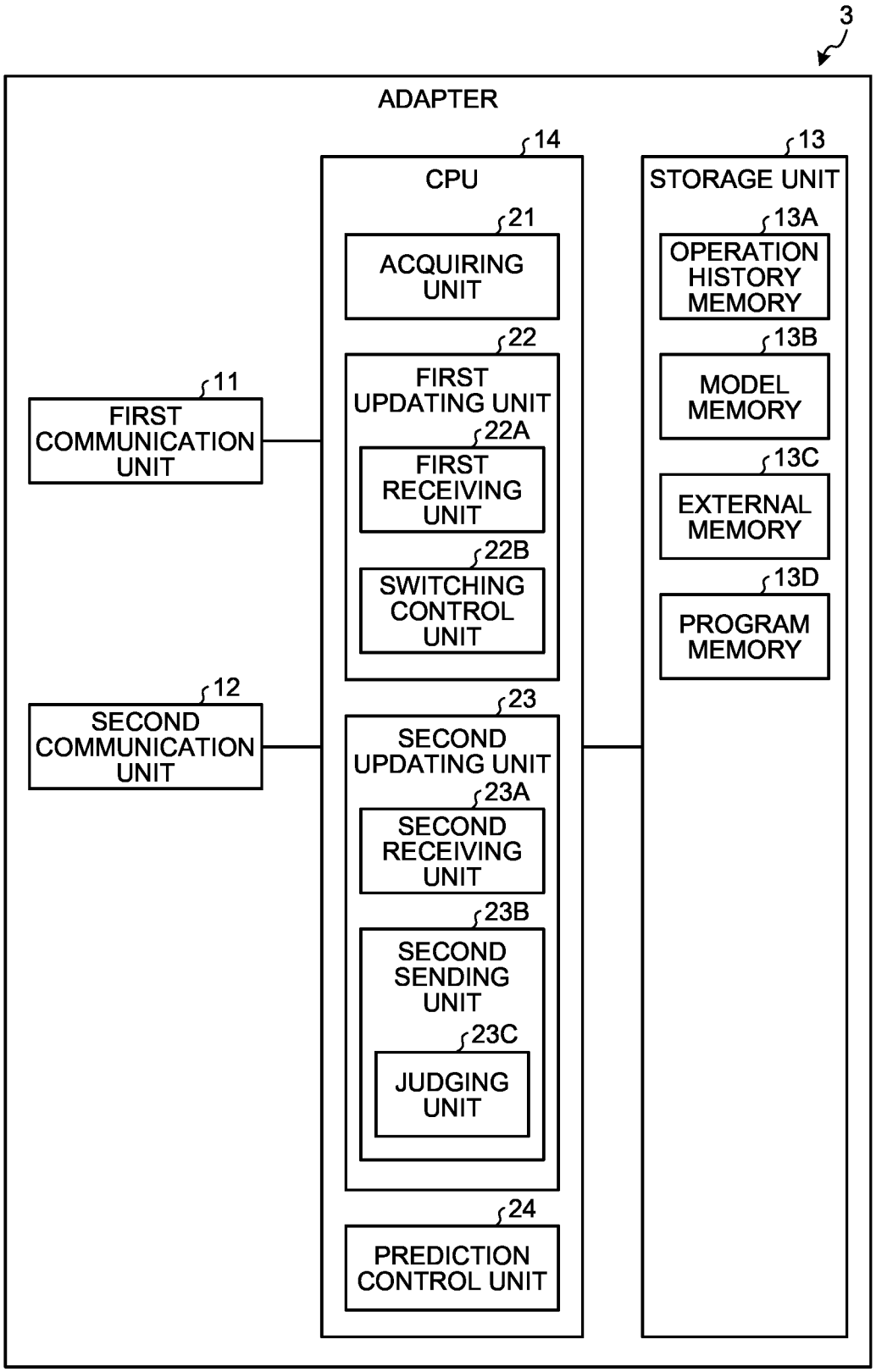
FIG. 2 is a block diagram illustrating an example of a configuration of an adapter.

FIG. 2 is a block diagram illustrating an example of a configuration of the adapter 3. The adapter 3 illustrated in FIG. 2 includes a first communication unit 11, a second communication unit 12, a storage unit 13, and a central processing unit (CPU) 14. The first communication unit 11 is a communication interface (IF), such as a universal asynchronous receiver transmitter (UART), that performs a communication connection with the control unit 2B included in the indoor unit 2. The second communication unit 12 is a communication unit of, for example, communication IF, such as a WLAN, that performs a communication connection with the router 4. The storage unit 13 includes, for example, a read only memory (ROM), a random access memory (RAM), or the like and stores various kinds of information, such as data and programs. The CPU 14 performs overall control of the adapter 3.

The storage unit 13 included in the adapter 3 illustrated in FIG. 2 includes an operation history memory 13A that temporarily stores therein the operation history data acquired from the indoor unit 2, a model memory 13B that stores therein a learning model acquired from the server device 5, an external memory 13C that stores therein external data, and a program memory 13D that stores therein an update control purpose program acquired from the server device 5. Furthermore, the update control purpose program is a program for updating a control program for the air conditioning system 1 from the server device 5, for example, a program for updating firmware or the like of the control unit 2B that controls the indoor unit 2.

The model memory 13B includes a plurality of storage areas 130, such as a first area 130A, a second area 130B, and a third area 130C. Examples of the status of each of the storage areas 130 include a state in which a written learning model can be read out (hereinafter, simply referred to as during readout), a state in which a new learning model is in the course of writing (hereinafter, simply referred to as during write), and a state in which a learning model is in a state other than during the readout operation and has already been written.

The CPU 14 includes an acquiring unit 21, a first updating unit 22, a second updating unit 23, and a prediction control unit 24.

The acquiring unit 21 acquires the operation history data from the indoor unit 2 at an acquiring timing of, for example, every 5 minutes in a predetermined period. The acquiring unit 21 stores the operation history data acquired in a period of 5 minutes in the operation history memory 13A. The acquiring unit 21 sends the operation history data that is being stored in the operation history memory 13A to the server device 5 through the communication network 8.

The first updating unit 22 receives the learning model from the server device 5 through the communication network 8 and stores the received learning model in the model memory 13B by using a first update method. The first updating unit 22 includes a first receiving unit 22A and a switching control unit 22B. The first receiving unit 22A receives a new learning model from the server device 5 through the communication network 8 and stores the received new learning model in the model memory 13B. When the new learning model is received from the server device 5, the switching control unit 22B writes the new learning model to the storage area 130 and switches the status of the storage area 130 that is in the state of during write the new learning model to the status of during readout. Furthermore, the first update method is a method for overwriting and storing the new learning model received by the first receiving unit 22A in the written storage area 130.

Figure 3:
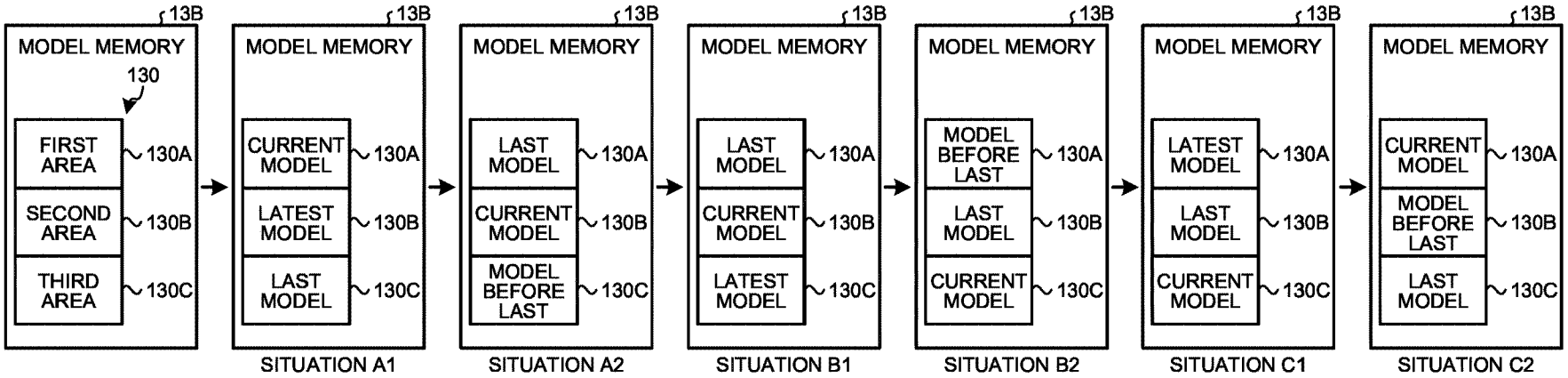
FIG. 3 is a diagram illustrating an example of writing and reading out each storage area in a model memory.

FIG. 3 is a diagram illustrating an example of writing and reading out each of the storage areas 130 in the model memory 13B. Furthermore, for convenience of description, it is assumed that, in a state of a situation A1, for example, a learning model (current model) that is in the state of during readout is stored in the first area 130A, a written learning model (last model) is stored in the third area 130C, and a new learning model (latest model) is written to the second area 130B, and it is assumed that, in the situation A2, the above described writing operation has already been completed. In the state of the situation A2, the latest learning model is stored in the second area 130B. Accordingly, control of the air conditioning system 1 based on the learning model is performed by the latest learning model (current model) stored in the second area 130B (the second area 130B enters the state of during readout). In this case, the learning model stored in the first area 130A is changed to the learning model of the last time (last model). Furthermore, the learning model stored in the third area 130C is changed to the learning model before last (model before last).

If the first receiving unit 22A receives a new learning model from the server device 5 in the state of the situation A2, the first receiving unit 22A writes, in an overwriting manner, the new learning model (latest model) and the receipt time into the already written third area 130C in which a learning model having the oldest receipt time (model before last) is written, except for the second area 130B in which the learning model (current model) is being read out. Consequently, the switching control unit 22B sets the state of the third area 130C to be in the state of during write (the situation B1). When the writing has been completed, the state enters the situation B2. Namely, control of the air conditioning system 1 based on the learning model is performed by the latest learning model (current model) stored in the third area 130C (the third area 130C enters the state of during readout). In this case, the learning model stored in the second area 130B is changed to the learning model last time (last model). Furthermore, the learning model stored in the first area 130A is changed to the learning model before last (model before last).

Similarly, when the first receiving unit 22A receives a new learning model from the server device 5 in the state of the situation B2, the first receiving unit 22A writes, in an overwriting manner, a new learning model (latest model) and the receipt time into the already written first area 130A in which a learning model having the oldest receipt time (model before last) is written, except for the third area 130C in which the learning model (current model) is being read out. Consequently, the switching control unit 22B sets the state of the first area 130A to be in the state of during write (a situation C1). When the writing has been completed, the state enters the situation C2. Namely, control of the air conditioning system 1 based on the learning model is performed by the latest learning model (current model) stored in the first area 130A (the first area 130A enters the state of during readout). In this case, the learning model stored in the third area 130C is changed to the learning model last time (last model). Furthermore, the learning model stored in the second area 130B is changed to the learning model before last (model before last). Then, the situation is sequentially switched by the switching control unit 22B every time a new learning model is received.

In the following, a second update method will be described. When the second updating unit 23 receives an update control purpose program for the control unit 2B included in the indoor unit 2 from the server device 5, the second updating unit 23 rewrites, regarding the update control purpose program, the control purpose program for the control unit 2B by using the second update method that is different from the first update method. The second updating unit 23 includes a second receiving unit 23A and a second sending unit 23B. The second receiving unit 23A stores the update control purpose program received from the server device 5 into the program memory 13D. The second sending unit 23B sends the update control purpose program stored in the program memory 13D to the control unit 2B included in the indoor unit 2.

Figure 4:
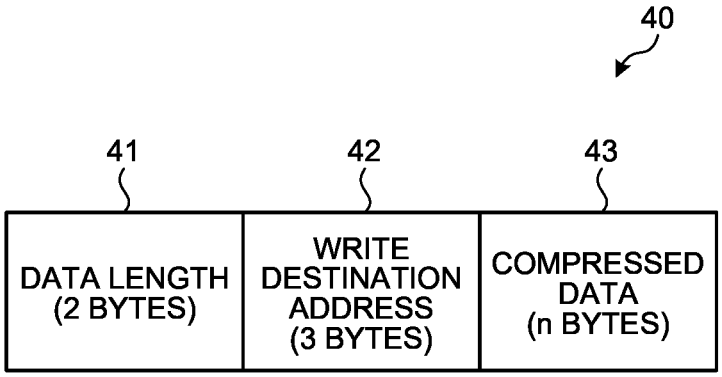
FIG. 4 is a diagram illustrating an example of a data structure of split data included in an update control purpose program.

FIG. 4 is a diagram illustrating an example of a data structure of a split data 40 included in the update control purpose program. The update control purpose program is constituted by a plurality of pieces of the split data 40 having a predetermined split data length. The split data 40 includes a data length 41, a write destination address 42, and a compressed data 43. The data length 41 is information (2 bytes) on the data length from the write destination address 42 to the compressed data 43. The write destination address 42 is address information (3 bytes) at the time of writing data to a block 52A included in a ROM 52 in the control unit 2B in the indoor unit 2 that is, for example, a target apparatus. The compressed data 43 is data with n bytes compressed by using a predetermined method. The capacity of the decompressed data of the compressed data 43 corresponds to, for example, the storage capacity of 1K byte (1024 bytes) of a single block in the ROM 52. For example, the data length 41 and the write destination address 42 are not compressed.

The second receiving unit 23A receives the split data 40 included in the update control purpose program from the server device 5 in units of split data. After having received the entire update control purpose program, the second receiving unit 23A sequentially stores the received split data 40 in the program memory 13D. Regarding the split data 40 stored in the program memory 13D, the second sending unit 23B refers to the data length 41 included in the split data 40, extracts data having the data length from the update control purpose program, and sequentially sends the split data 40 to the control unit 2B included in the indoor unit 2. After the indoor unit 2 receives the split data 40, the indoor unit 2 decompresses the split data 40 and writes the decompressed split data 40 to the block 52A. Furthermore, after the indoor unit 2 has written the split data to the block 52A, the indoor unit 2 notifies the adapter 3 of the completion of writing of the split data 40. The second sending unit 23B included in the adapter 3 includes a judging unit 23C that judges whether, when it is detected that the completion of writing of the split data 40 that has been sent from the indoor unit 2 onto the block 52A, the split data 40 that has not been sent to the indoor unit 2 is present in the program memory 13D. When the split data 40 that has not been sent is present in the program memory 13D, the second sending unit 23B sends the unsent split data 40 to the control unit 2B included in the indoor unit 2.

The prediction control unit 24 controls the control unit 2B included in the indoor unit 2 based on the learning model. Furthermore, for convenience of description, a case in which the prediction control unit 24 controls the control unit 2B included in the indoor unit 2 based on the learning model has been exemplified; however, the prediction control unit 24 may also directly control the main body 2A included in the indoor unit 2 based on the learning model. Furthermore, the prediction control unit 24 transits a control mode based on the learning model to the control unit 2B. Namely, the prediction control unit 24 may also indirectly control the main body 2A via the control unit 2B, and modifications are possible as needed. When the CPU 14 included in the adapter 3 detects a download request for the learning model, the CPU 14 executes a first updating process and, when the CPU 14 detects a download request for the update control program, the CPU 14 executes an update switching process that performs a second updating process.

Figure 5:
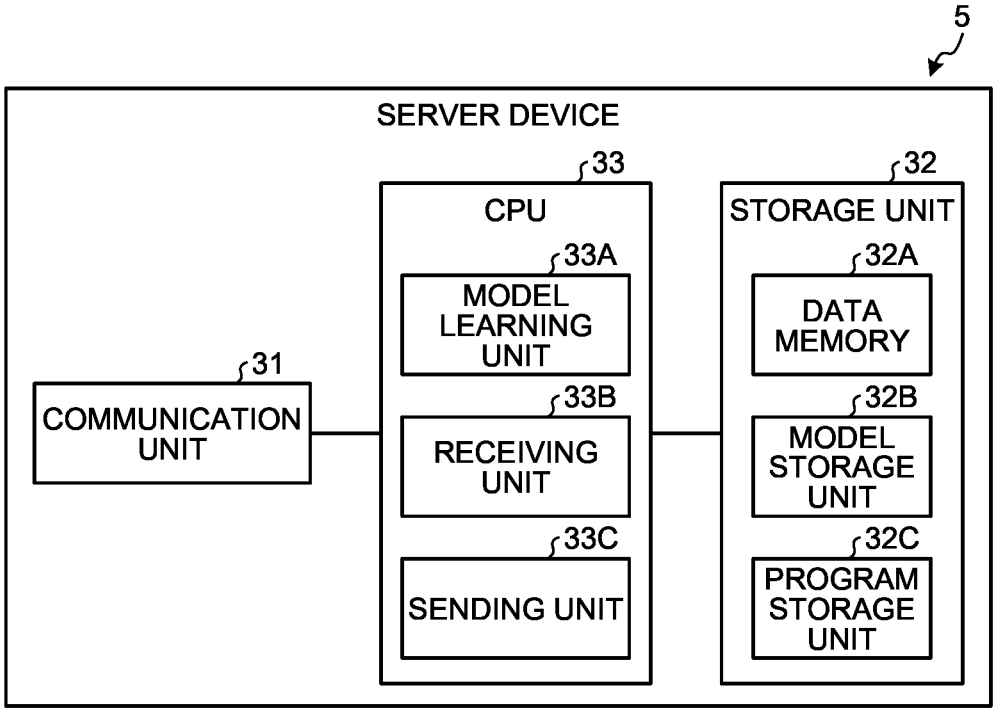
FIG. 5 is a block diagram illustrating an example of a configuration of a server device.

FIG. 5 is a block diagram illustrating an example of a configuration of the server device 5. The server device 5 illustrated in FIG. 5 includes a communication unit 31, a storage unit 32, and a CPU 33. The communication unit 31 is a communication IF that performs a communication connection to the relay device 6. The storage unit 32 includes, for example, a hard disk drive (HDD), a ROM, a RAM, and the like and stores various kinds of information, such as data and programs. The CPU 33 performs overall control of the server device 5.

The storage unit 32 included in the server device 5 illustrated in FIG. 5 includes a data memory 32A, a model storage unit 32B, and a program storage unit 32C. The data memory 32A stores therein operation history data or the like received from each of the adapters 3. The model storage unit 32B stores therein the learning model that is generated or updated by the server device 5. The program storage unit 32C stores therein the plurality of pieces of the split data 40 included in the update control purpose program that is generated or updated by the server device 5 in units of the split data 40.

The CPU 33 included in the server device 5 includes a model learning unit 33A, a receiving unit 33B, and a sending unit 33C.

The model learning unit 33A connects each of the adapters 3 included in the plurality of the indoor units 2 and receives operation history data by an amount corresponding to 48 hours from each of the adapters 3 through the router 4, the communication network 8, and the relay device 6. Then, the model learning unit 33A performs learning by using the operation history data by an amount corresponding to 48 hours that is being stored in the data memory 32A received from each of the adapters 3, and then, generates or updates the learning model of each of the indoor units 2. The learning model includes, for example, a sensible temperature set prediction model that predicts a sensible temperature of a user in a room five minutes later in accordance with an operation situation of the air conditioner in individual home and that controls an air conditioner in accordance with the sensible temperature to be predicted.

The model learning unit 33A generates or updates the learning models associated with the respective adapters 3 based on the operation history data, by an amount corresponding to 48 hours for each of the adapters 3, that is being stored in the data memory 32A and stores the generated or the updated learning model in the model storage unit 32B. The sending unit 33C sends the learning model that has been generated or updated in the model learning unit 33A to the adapter 3 through the relay device 6, the communication network 8, and the router 4. Furthermore, the sending unit 33C sends the split data 40 included in the update control purpose program stored in the program storage unit 32C to the adapter 3 through the relay device 6, the communication network 8, and the router 4.

Figure 6:
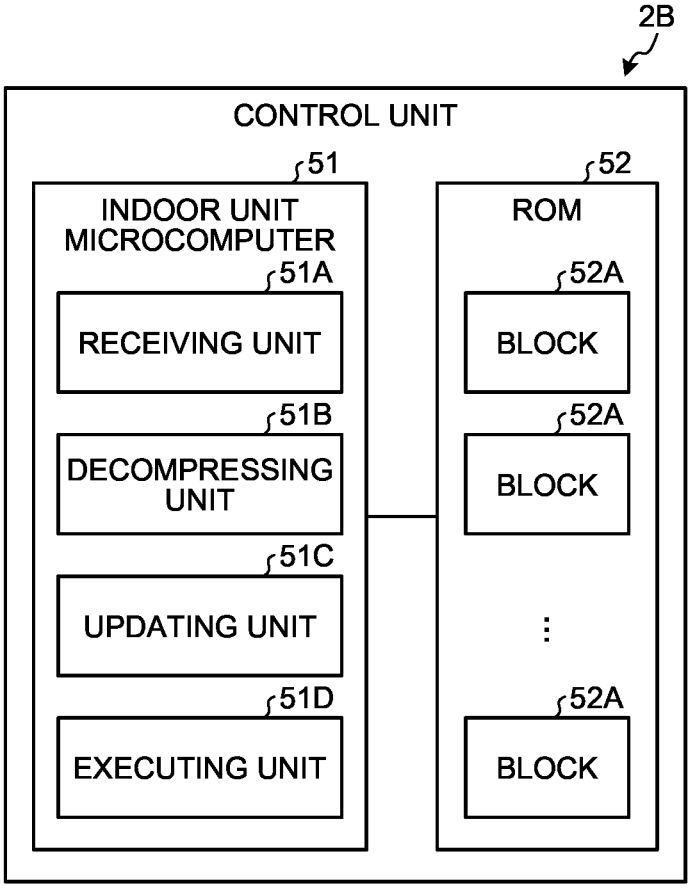
FIG. 6 is a block diagram illustrating an example of a configuration of a control unit included in an indoor unit.

FIG. 6 is a block diagram illustrating an example of a configuration of the control unit 2B in the indoor unit 2. The control unit 2B illustrated in FIG. 6 includes an indoor unit microcomputer 51 and a read only memory (ROM) 52. The ROM 52 includes a plurality of the blocks 52A and the storage capacity of each of the blocks 52A is assumed to be 1024 bytes. Furthermore, the write destination address 42 of the split data 40 that is an address for identifying each of the blocks 52A included in the ROM 52.

The indoor unit microcomputer 51 is a receiving unit 51A, a decompressing unit 51B, an updating unit 51C, and an executing unit 51D. The receiving unit 51A receives the split data 40 included in the update control purpose program sent from the adapter 3. When the decompressing unit 51B receives the split data 40, the decompressing unit 51B refers to the write destination address 42 included in the split data 40 and decompresses the compressed data 43 included in the split data 40. The updating unit 51C refers to the write destination address 42 included in the split data 40 and overwrites the decompressed data to the block 52A that is included in the ROM 52 and that is associated with the write destination address 42. If overwriting of all of the pieces of the split data 40 included in the update control purpose program to all of the blocks 52A included in the ROM 52 has been completed and if all of the pieces of data that have been subjected to overwriting are normal, the executing unit 51D reboots the indoor unit microcomputer 51. Whether or not the data is normal is determined whether, for example, a checksum value of the entire of the overwritten update control purpose program matches the value that is added to the update control purpose program as data. Furthermore, when the indoor unit microcomputer 51 performs a reboot, the indoor unit microcomputer 51 temporarily stops the indoor unit 2.

Figure 7:
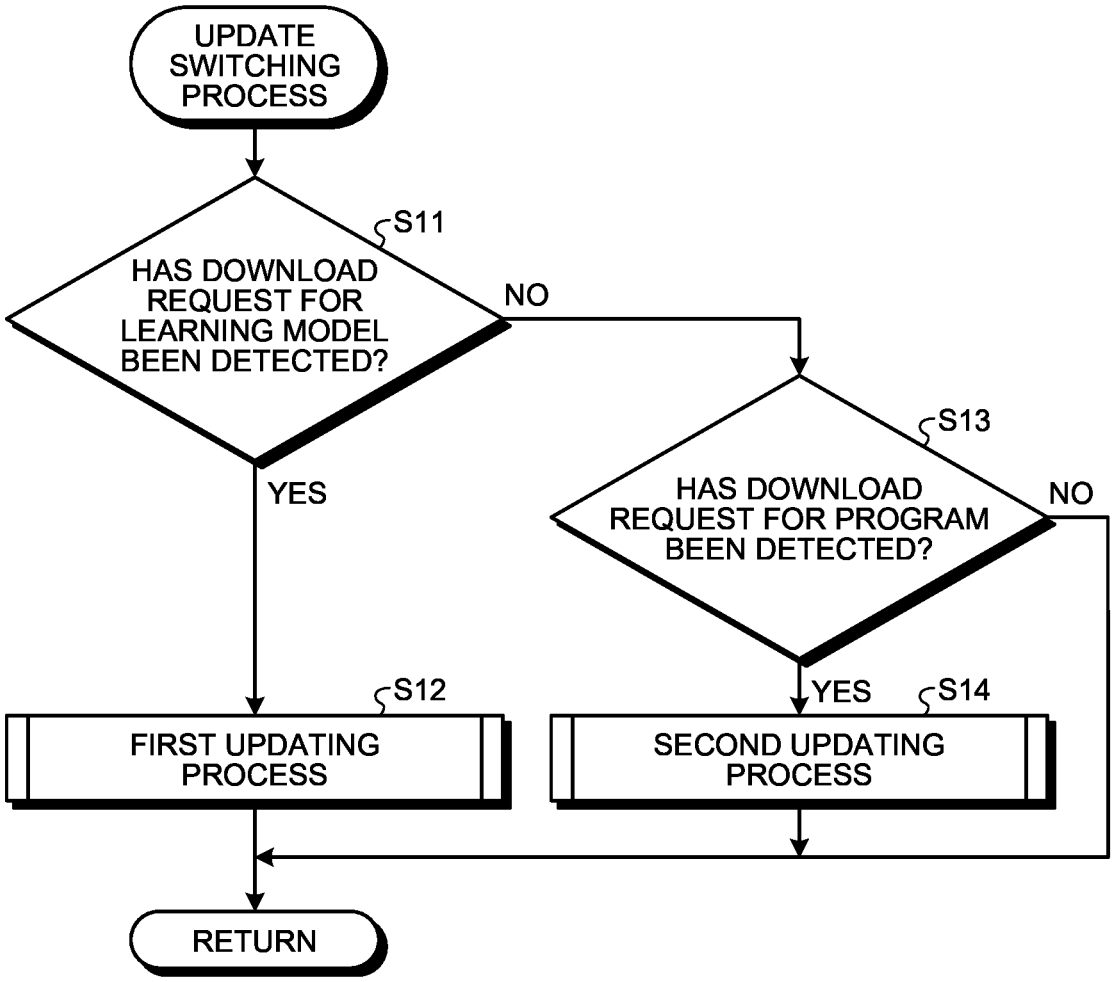
FIG. 7 is a flowchart illustrating an example of a processing operation of a CPU included in the adapter related to an update switching process.

In the following, an operation of the air conditioning system 1 according to the embodiment will be described. FIG. 7 is a flowchart illustrating an example of a processing operation performed by the CPU 14 included in the adapter 3 according to the update switching process. In FIG. 7, when the first updating unit 22 included in the CPU 14 in the adapter 3 judges whether the download request for the learning model from the server device 5 has been detected (Step S11). When the first updating unit 22 has detected the download request for the learning model (Yes at Step S11), the first updating unit 22 performs the first updating process illustrated in FIG. 8 (Step S12), and ends the processing operation illustrated in FIG. 7. Furthermore, the first updating process is a process of updating the learning model performed by using the first update method.

Furthermore, if the first updating unit 22 does not detect the download request for the learning model (No at Step S11), the second updating unit 23 included in the CPU 14 judges whether the download request for the update control purpose program from the server device 5 has been detected (Step S13). If the second updating unit 23 has detected the download request for the update control purpose program (Yes at Step S13), the second updating unit 23 performs the second updating process illustrated in FIG. 9 (Step S14), and ends the processing operation illustrated in FIG. 7. Furthermore, the second updating process is a process of updating the control purpose program for the control unit 2B in the indoor unit 2 performed by using the second update method. Furthermore, if the download request for the update control purpose program is not detected (No at Step S13), the CPU 14 ends the processing operation illustrated in FIG. 7.

As described above, if the adapter 3 has detected a download request for the learning model from the server device 5, the adapter 3 updates the learning model by using the first update method and, if the adapter 3 has detected a download request for the update control purpose program from the server device 5, the adapter 3 updates the control purpose program included in the control unit 2B in the indoor unit 2 by using the second update method. As a result, by updating learning model and the control purpose program included in the control unit 2B by using the different method, the adapter 3 allows the control unit 2B included in the indoor unit 2 to overwrite the split data 40 by sequentially sending the split data 40 to the indoor unit 2 without performing a process (in other words, a "useless process") other than the process that is originally needed to the adapter (for example, transmission and reception of data and storing the learning model), whereby it is possible to reduce a load applied to the adapter 3.

Figure 8:
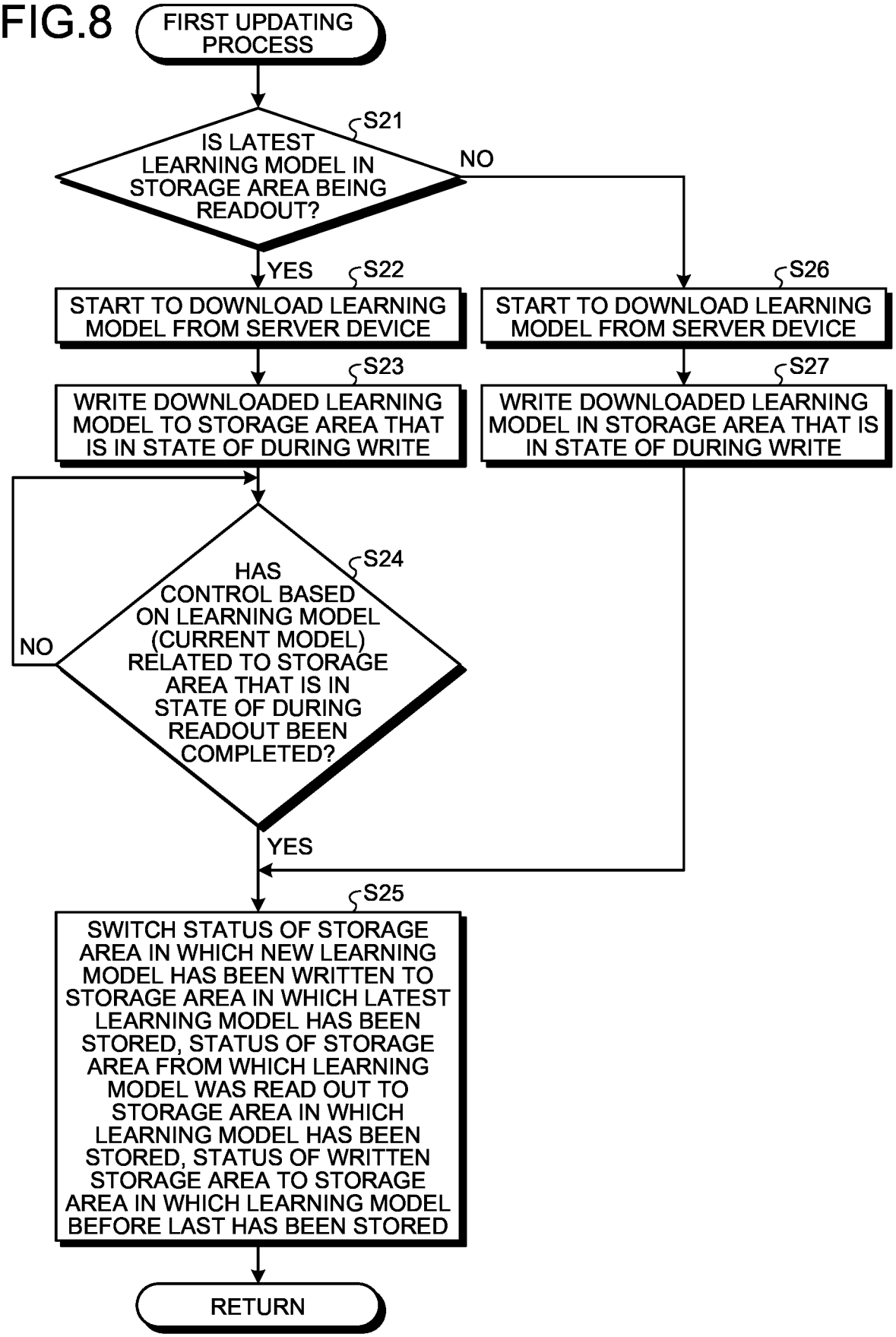
FIG. 8 is a flowchart illustrating an example of a processing operation of the CPU included in the adapter related to a first updating process.

FIG. 8 is a flowchart illustrating an example of the processing operation performed by the CPU 14 included in the adapter 3 according to the first updating process. In FIG. 8, the first updating unit 22 included in the CPU 14 judges whether the latest learning model in the storage area 130 is being read out (Step S21). If the learning model in the storage area 130 is being read out (Yes at Step S21), the first receiving unit 22A included in the first updating unit 22 starts to download a new learning model from the server device 5 (Step S22). The switching control unit 22B included in the first updating unit 22 writes the new learning model downloaded by the first receiving unit 22A to the storage area 130 that is in the state of during write (Step S23), and judges whether control performed based on the latest learning model (current model) in the storage area 130 that is in the state of during readout has been completed (Step S24). Furthermore, the control performed based on the latest learning model (current model) in the storage area 130 that is in the state of during readout mentioned here is control for providing a recommended operation to the control unit 2B included in the indoor unit 2 based on the learning model (current model) in the storage area 130.

If the switching control unit 22B has completed the control performed based on the learning model (current model) in the storage area 130 that is in the state of during readout (Yes at Step S24), the switching control unit 22B switches the status of the storage area 130 in which the new learning model has been written to the "storage area 130 in which the latest learning model has been stored", switches the status of the storage area 130 in which the learning model was reading out to the "storage area 130 in which the last time learning model is stored", switches the status of the already written storage area 130 to the "storage area 130 in which the before last learning model has been stored" (Step S25), and ends the processing operation illustrated in FIG. 8.

If the latest learning model in the storage area 130 is not in the state of during readout (No at Step S21), the first receiving unit 22A starts to download a new learning model from the server device 5 (Step S26). The switching control unit 22B writes the new learning model downloaded by the first receiving unit 22A to the storage area 130 (Step S27), and moves to the process at Step S25 in order to switch the status of the storage area 130 in which the new learning model has been written.

If the first updating unit 22 does not complete the control based on the latest learning model (current model) in the storage area 130 that is in the state of during readout (No at Step S24), the first updating unit 22 returns to the process at Step S24 in order to judge whether the control has been completed.

As described above, regarding the new learning model received from the server device 5, the adapter 3 writes the new learning model and the receipt time to the written storage area 130 having the oldest receipt time from among the plurality of the storage areas 130 except for the storage area 130 that is in the state of during readout. As a result, the adapter 3 can overwrite the new learning model in the model memory 13B while using the learning model that is in the state of during readout. Accordingly, it is possible to avoid a situation of a stop of the indoor unit 2 even when the learning model is updated.

Figure 9:
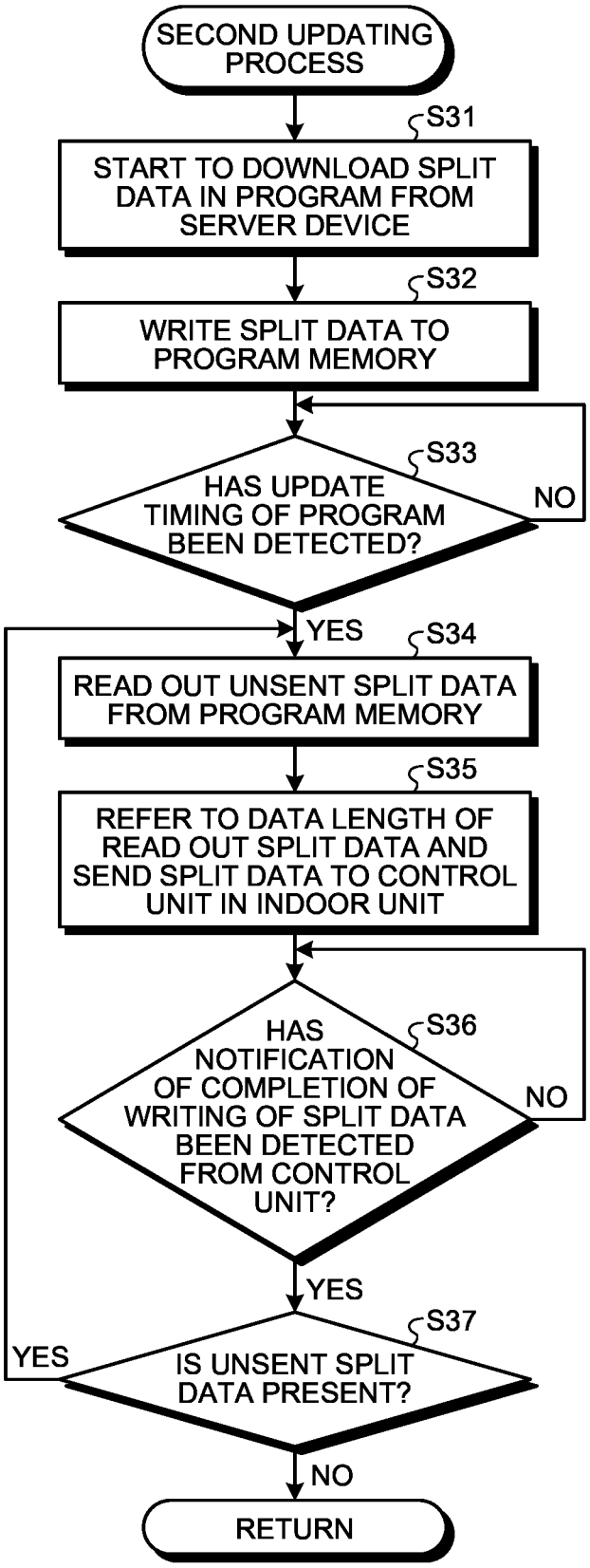
FIG. 9 is a flowchart illustrating an example of a processing operation of the CPU included in the adapter related to a second updating process.

FIG. 9 is a flowchart illustrating an example of the processing operation performed by the CPU 14 included in the adapter 3 according to the second updating process. In FIG. 9, the second receiving unit 23A included in the second updating unit 23 in the CPU 14 starts to download the plurality of pieces of the split data 40 included in the update control purpose program from the server device 5 (Step S31), and stores the split data 40 in the program memory 13D (Step S32). The second updating unit 23 judges whether the program update timing has been detected (Step S33). Furthermore, the program update timing is, for example, whether an update of the update control purpose program is possible on the control unit 2B side included in the indoor unit 2, for example, whether it is update time (absence time of a user) of the update control purpose program designated by the user of the indoor unit 2.

When the second sending unit 23B included in the second updating unit 23 detects the program update timing (Yes at Step S33), the second sending unit 23B reads out, from the program memory 13D, the unsent split data 40 (Step S34), refers to the data length 41 of the read out split data 40, extracts the data by an amount corresponding to the data length from the update control purpose program, and sends the extracted split data 40 to the control unit 2B in the indoor unit 2 (Step S35). Namely, because the adapter 3 can sequentially send the pieces of the split data 40 to the indoor unit 2 without performing the process (in other words, a "useless process") other than the process that is originally needed for the adapter (for example, transmission and reception of data and storing the learning model), it is possible to reduce a processing load applied to the adapter.

The second sending unit 23B judges whether a notification of completion of overwriting of the split data 40 sent from the control unit 2B has been detected (Step S36). If the notification of completion of overwriting of the sent split data 40 sent from the control unit 2B has been detected (Yes at Step S36), the judging unit 23C judges whether the unsent split data 40 is present in the program memory 13D (Step S37). If the unsent split data 40 is present in the program memory 13D (No at Step S37), the second updating unit 23 determines that transmission of all of the pieces of the split data 40 included in the update control purpose program with respect to the control unit 2B has been completed, and ends the processing operation illustrated in FIG. 9.

If the second updating unit 23 does not detect the program update timing (No at Step S33), the second updating unit 23 returns to the process at Step S33 in order to determine whether the program update timing has been detected. If the second updating unit 23 does not detect the notification of overwriting of the split data 40 sent from the control unit 2B (No at Step S36), the second updating unit 23 returns to the process at Step S36 in order to determine whether the notification of completion of overwriting of the split data 40 sent from the control unit 2B has been detected.

If the split data 40 that has not been sent is present in the program memory 13D (Yes at Step S37), the second sending unit 23B returns to the process at Step S34 in order to read out the unsent split data 40 from the program memory 13D.

As described above, the adapter 3 sequentially receives each of the plurality of pieces of the split data 40 included in the update control purpose program from the server device 5 and stores the received split data 40 in the program memory 13D. The adapter 3 sequentially sends the unsent split data 40 included in the update control purpose program stored in the program memory 13D to the control unit 2B included in the indoor unit 2. As a result, because the adapter 3 can sequentially send large volumes of the split data 40 included in the update control purpose program to the control unit 2B without performing the useless process, it is possible to reduce the processing load applied to the adapter.

Figure 10:
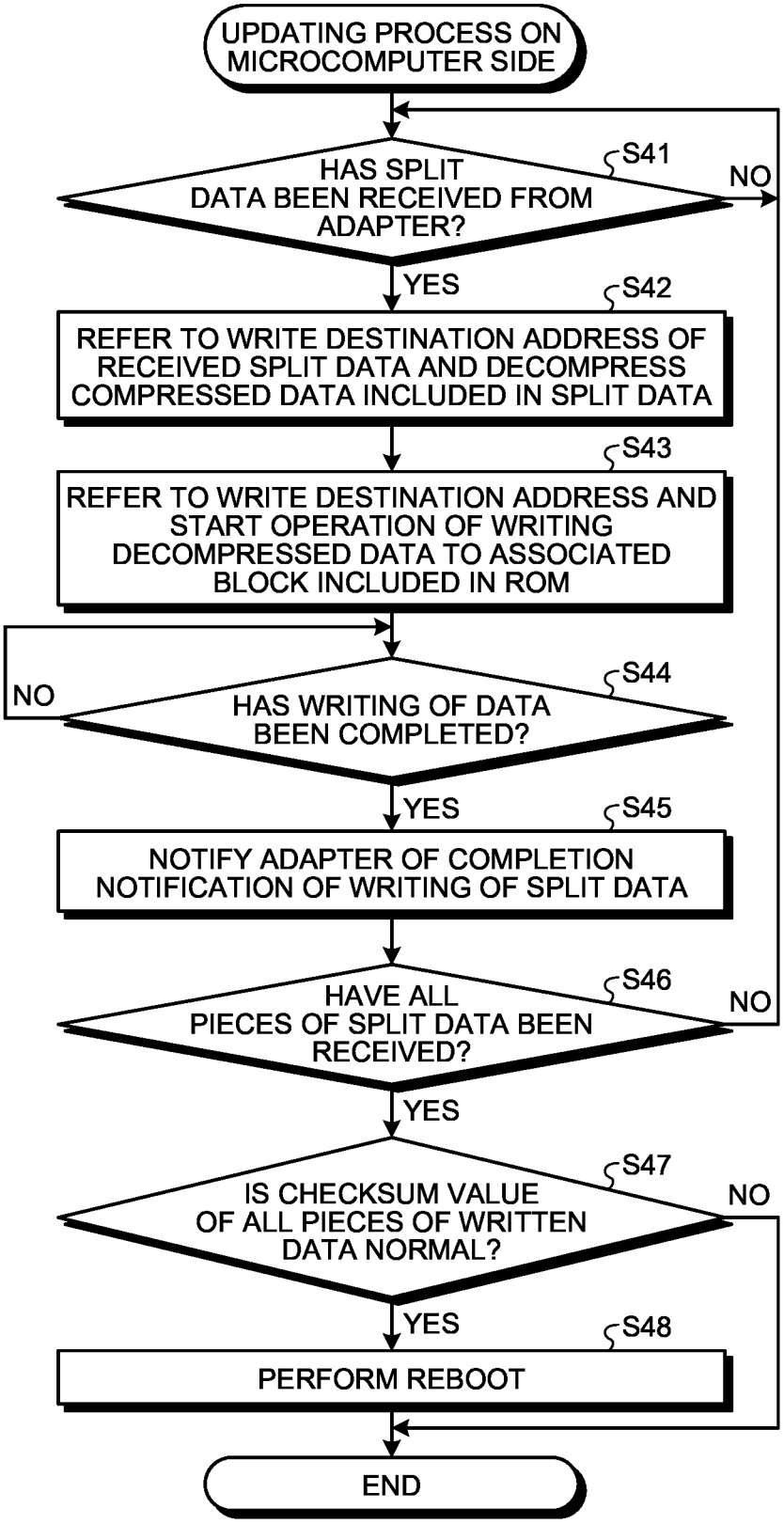
FIG. 10 is a flowchart illustrating an example of a processing operation of an indoor unit microcomputer included in the control unit related to an updating process performed on the microcomputer side.

FIG. 10 is a flowchart illustrating an example of the processing operation of the indoor unit microcomputer 51 included in the control unit 2B related to the updating process performed on the microcomputer side. In FIG. 10, the receiving unit 51A included in the indoor unit microcomputer 51 judges whether the plurality of pieces of the split data 40 has been received from the adapter 3 (Step S41). When the decompressing unit 51B included in the indoor unit microcomputer 51 receives the plurality of pieces of the split data 40 from the adapter 3 (Yes at Step S41), the decompressing unit 51B refers to the write destination address 42 in the received split data 40 and decompresses only the compressed data 43 in the received split data 40 (Step S42).

The updating unit 51C included in the indoor unit microcomputer 51 starts an operation of writing the decompressed data to the block 52A that is included in the ROM 52 and that is associated with the write destination address 42 (Step S43), and judges whether writing of the data to the subject block 52A has been completed (Step S44). Furthermore, in the indoor unit microcomputer 51, it is possible to write the decompressed data to the block 52A by referring to the write destination address 42 in the split data 40. As a result, it is possible to improve a decrease in time needed to the writing operation and improve suppression of degradation of the ROM 52 due to useless writing.

When the updating unit 51C has completed writing of the data to the subject block 52A (Yes at Step S44), the updating unit 51C notifies the adapter 3 of the completion of writing of the split data 40 (Step S45). The updating unit 51C judges whether all of the pieces of the split data 40 included in the update control purpose program have been received (Step S46). If the updating unit 51C has received all of the pieces of the split data 40 included in the update control purpose program (Yes at Step S46), the updating unit 51C judges, based on the checksum value, whether all of the pieces of data in which writing has been completed are normal (Step S47).

If all of the pieces of data in which writing has been completed are normal (Yes at Step S47), the executing unit 51D included in the indoor unit microcomputer 51 executes a reboot of the indoor unit microcomputer 51 (Step S48), and ends the processing operation illustrated in FIG. 10.

If the receiving unit 51A does not receive the split data 40 from the adapter 3 (No at Step S41), the receiving unit 51A returns to the process at Step S41 in order to judge whether the split data 40 has been received. If the writing of the data has not been completed (No at Step S44), the updating unit 51C returns to the process at Step S44 in order to continue monitoring whether writing of data started at Step S43 has been completed.

If the updating unit 51C does not receive all of the pieces of the split data 40 (No at Step S46), the updating unit 51C returns to the process at Step S41 in order to judge whether the split data 40 has been received from the adapter 3. If not all of the pieces of the data in which writing has been completed are normal (No at Step S47), the updating unit 51C reports a user of, for example, an unwritable state, and ends the processing operation illustrated in FIG. 10.

As described above, the control unit 2B included in the indoor unit 2 receives the split data 40 from the adapter 3, decompresses the compressed data 43 included in the received split data 40, and writs the decompressed data to the block 52A associated with the write destination address 42 in the split data 40. Then, after the control unit 2B writes all of the pieces of decompressed data in the split data 40 included in the update control purpose program to all of the blocks 52A, the control unit 2B reboots the indoor unit 2 if all of the pieces data in which writing has been completed are normal. As a result, the control unit 2B included in the indoor unit 2 can update the update control purpose program while improving a decrease in time needed to the writing operation and suppression of degradation of the ROM 52 due to useless writing.

The adapter 3 according to the embodiment updates the learning model by using the first update method and updates the program for the control unit 2B by using the second update method. As a result, because the update methods are different between the update of the learning model and the update of the program, it is possible to reduce the load applied to the adapter 3.

Furthermore, in the embodiment, as the update control purpose program of the air conditioning system 1, for example, the update control purpose program for updating the firmware of the indoor unit 2 has been exemplified; however, it may also be able to use an update control purpose program for updating the firmware of the adapter 3, an update control purpose program for updating the firmware of the control unit 2B that controls the indoor unit 2, or the like, and modifications are possible as needed.

It has been exemplified a case in which, when the adapter 3 receives a new learning model from the server device 5, the adapter 3 overwrites the received new learning model to the written storage area 130. However, it may also be possible to delete the learning model at the time point at which the written storage area 130 is changed to the storage area 130 that is in a state of during write, and modifications are possible as needed.

It has been exemplified a case in which the storage area 130 included in the model memory 13B in the adapter 3 is constituted by the first area 130A, the second area 130B, and the third area 130C. However, the configuration is not limited to these three storage areas 130 as long as, for example, at least two or more of the storage areas 130 are used, and modifications are possible as needed.

Furthermore, when the indoor unit microcomputer 51 receives the split data from the adapter 3, the indoor unit microcomputer 51 may also decompress the split data and compare the decompressed data with the data stored in the block 52A targeted for the write operation. If the pieces of compared data are the same, the indoor unit microcomputer 51 may also compare, without writing the data to the subject block 52A, the subsequent decompressed data with the data stored in the block 52A targeted for the write operation. As a result, by reducing the number of times of useless writing operations, it is possible to extend the life of the indoor unit microcomputer 51. In addition, the adapter 3 does not need to check whether there is a need to perform a write operation in the subject block 52A for each of the pieces of the split data 40.

Furthermore, the components of each unit illustrated in the drawings are not always physically configured as illustrated in the drawings. In other words, the specific shape of a separate or integrated device is not limited to the drawings. Specifically, all or part of the device can be configured by functionally or physically separating or integrating any of the units depending on various loads or use conditions.

Furthermore, all or any part of various processing functions performed by each unit may also be executed by a central processing unit (CP) (or a microcomputer, such as a micro processing unit (MPU), a micro controller unit (MCU), or the like). Furthermore, all or any part of various processing functions may also be, of course, executed by programs analyzed and executed by the CPU (or the microcomputer, such as the MPU or the MCU), or executed by hardware by wired logic.

EXPLANATION OF REFERENCE

1 air conditioning system
2 indoor unit
2A main body
2B control unit
3 adapter
5 server device
13B model memory
13D program memory
22 first updating unit
22A first receiving unit
22B switching control unit
23 second updating unit
23A second receiving unit
23B second sending unit
23C judging unit

The invention claimed is:

1. An air conditioning system comprising:

an air conditioner; and an adapter that connects the air conditioner and an external server device, wherein the adapter includes a first processor that updates, when a new learning model that provides a recommended operation to a control unit included in the air conditioner is received from the external server device, the learning model by using a first update method, and a second processor that rewrites, when an update purpose control program that updates a control program for the air conditioner is received from the external server device, the update purpose control program and updates the update purpose control program by using a second update method that is different from the first update method; and wherein the update purpose control program is formed of a plurality of pieces of split data having a predetermined data length, a write destination address indicating a write destination used at the time of writing the split data to an indoor unit is added to the split data, and the second processor includes a second storage that stores therein the update purpose control program received from the server device, and a transmitter that sequentially sends the update purpose control program in units of the predetermined data length to the indoor unit by referring to the write destination address.

2. The air conditioning system according to claim 1, wherein the first processor includes a first storage that includes a first area that stores therein the new learning model and a second area that stores therein a current learning model, and a switching controller that stores, when the new learning model has been detected from the external server device, the new learning model in the first area and that switches the first area to the second area, and the first processor provides the recommended operation to the air conditioner by using the new learning model switched to the second area.

3. The air conditioning system according to claim 1, wherein the split data is compressed by using a predetermined method, whereas the write destination address is not compressed.

* * * * *